US010947757B2

(12) United States Patent
Taylor et al.

(10) Patent No.: US 10,947,757 B2
(45) Date of Patent: Mar. 16, 2021

(54) INTERLOCK SECURITY DEVICE

(71) Applicant: Meshtec International Co., Ltd., Chiang Mai (TH)

(72) Inventors: Peter Syme Taylor, Chiang Mai (TH); David Neil Edlin, Chiang Mai (TH)

(73) Assignee: Meshtec International Co., Ltd.

( * ) Notice: Subject to any disclaimer, the term of this patent is extended or adjusted under 35 U.S.C. 154(b) by 730 days.

(21) Appl. No.: 15/718,921

(22) Filed: Sep. 28, 2017

(65) Prior Publication Data

US 2018/0100330 A1 Apr. 12, 2018

Related U.S. Application Data

(60) Provisional application No. 62/407,134, filed on Oct. 12, 2016.

(51) Int. Cl.

| | |
|---|---|
| ***E05B 65/08*** | (2006.01) |
| ***E05C 7/04*** | (2006.01) |
| ***E05B 17/20*** | (2006.01) |
| *E05C 7/00* | (2006.01) |
| *E05B 63/00* | (2006.01) |

(52) U.S. Cl.

CPC ..... *E05B 65/08* (2013.01); *E05B 17/2084* (2013.01); *E05C 7/045* (2013.01); *E05B 63/0056* (2013.01); *E05C 2007/007* (2013.01)

(58) Field of Classification Search

CPC .... Y10S 292/46; Y10S 292/21; Y10S 292/16; Y10S 292/51; Y10T 292/37; Y10T 292/096; Y10T 292/34; Y10T 24/44632; Y10T 292/0902; E05B 65/08; E05B 65/0894; E05B 63/0056; E05B 65/0014; E05B 65/0888; E05B 2047/0059; E05B 65/0852; E05B 83/40; E05C 19/182; E05C 7/045; E05C 17/54; E05C 17/62; E05C 19/001; E05C 19/066; E05C 19/18; E06B 3/469

See application file for complete search history.

(56) References Cited

U.S. PATENT DOCUMENTS 3,478,471 A * 11/1969 Hodge ..... E05B 65/0888 49/449
4,190,272 A * 2/1980 Beard ..... E05B 65/0864 292/251

(Continued)

*Primary Examiner* — Mark A Williams
(74) *Attorney, Agent, or Firm* — Harness, Dickey & Pierce, P.L.C.

(57) ABSTRACT

A mountable interlock security device for securing first and second sliding articles slidable relative to each other from an open position to a closed position such that in the closed position the sliding articles have overlapping interior edges. The security device comprises a first component mountable to the first sliding article and a second component mountable to the interior edge of the second sliding article. The two components of the security device are mounted to the overlapping end regions of respective sliding articles such that when the sliding articles are in the closed position, the two components of the security device cooperate to limit lateral movement of the sliding articles. In another aspect, a method of retrofitting interior and exterior sliding articles, such as doors or windows, of a building with a security device is provided.

12 Claims, 11 Drawing Sheets

(56) References Cited

U.S. PATENT DOCUMENTS

| | | | | |
|---|---|---|---|---|
| 5,623,841 | A * | 4/1997 | Deemar | E05C 19/182 292/262 |
| 5,857,291 | A * | 1/1999 | Headrick | E05C 1/04 292/145 |
| 6,070,922 | A * | 6/2000 | Gross | E05B 65/0894 292/259 R |
| 6,367,852 | B1 * | 4/2002 | Aspenwall | E05B 65/0894 292/281 |
| 6,394,510 | B1 * | 5/2002 | Stewart, III | E05B 65/0888 292/264 |
| 6,484,445 | B2 * | 11/2002 | Chang | E05B 65/0823 292/289 |
| 2004/0207216 | A1 * | 10/2004 | Sio | E06B 3/4609 292/340 |
| 2006/0032161 | A1 * | 2/2006 | Kalempa | E06B 3/822 52/204.1 |
| 2007/0175121 | A1 * | 8/2007 | Speyer | E06B 3/469 52/207 |
| 2008/0302021 | A1 * | 12/2008 | Gosling | E05B 65/0876 49/475.1 |
| 2018/0100330 | A1 * | 4/2018 | Taylor | E05B 65/08 |

* cited by examiner

INTERLOCK SECURITY DEVICE

CROSS-REFERENCE TO RELATED APPLICATIONS

This application claims the benefit of U.S. Provisional Application No. 62/407,134, filed on Oct. 12, 2016. The entire disclosure of the above application is incorporated herein by reference.

TECHNICAL FIELD

The present disclosure relates to security devices, and in particular to security devices for sliding articles for buildings.

BACKGROUND

Sliding articles, such as sliding doors or sliding windows, may be found in commercial buildings or backyard entries of residential buildings intended to permit the passage of light into the building interior while keeping out unauthorized users. The sliding doors of a building slide adjacent to one another between open and closed positions. These sliding articles, however, are susceptible to being pried open by force. Intruders can use a crowbar or other object to apply lateral force between the frames of adjacent sliding articles to pry apart the doors or windows and gain unauthorized entry into the building's interior. Thus, some means of limiting unauthorized entry to a residence's interior through sliding articles is desired.

SUMMARY

According to one aspect of the present disclosure, a mountable interlock security device is provided for securing first and second sliding articles defining interior and exterior articles having a gap therebetween. The sliding articles are slidable relative to each other from an open position to a closed position such that in the closed position, each first and second sliding article has an overlapping end region defined by an outer face and an inner face connected by an edge. The security device comprises a first component mountable to at least a portion of the end region of the first sliding article. The first component has one part of an interlocking means for extending into the gap between the first and second sliding articles.

The security device comprises a second component mountable to the end region of the second sliding article. The second component comprises a bracket slidably mountable to the end region of the second sliding article. The bracket has a channel mountable adjacent the edge of the sliding article and facing the gap. An extendable member is receivable in the bracket for extending into the gap for accommodating various spacing between the first and second sliding articles. The extendable member has an other part of the interlocking means for extending into the gap between the first and second sliding articles. In use, the one part of the interlocking means cooperates with the other part of the interlocking means for limiting lateral movement of the first and second sliding articles in the closed position upon the application of lateral force.

There is provided a mountable interlock security device for securing first and second sliding articles defining interior and exterior articles having a gap therebetween, the first and second sliding articles being slidable relative to each other from an open position to a closed position such that in the closed position each first and second sliding article has an overlapping end region defined by an outer face and an inner face connected by an edge, the security device comprising: a first component mountable to at least a portion of the end region of the first sliding article; said first component having a one part of an interlocking means for extending into the gap between the first and second sliding articles; and a second component mountable to the end region of the second sliding article; said second component having an other part of the interlocking means for extending from said extendable member into the gap between the first and second sliding articles; wherein said one part of the interlocking means of said first part cooperates with said other part of the interlocking means of said second part for limiting lateral movement of the first and second sliding articles in the closed position upon the application of lateral force.

A method of retrofitting interior and exterior sliding articles of a building slidable relative to each other from an open position to a closed position and defining a gap therebetween is also provided. The method comprises providing a mountable interlock security device comprising a first component with a one part of an interlocking means and a second component having an extendable member where the extendable member has an other part of the interlocking means. The first component is mounted to the interior sliding article so that the one part of the interlocking means extends into the gap. The second component is mounted to the exterior sliding article so that the extendable member extends into the gap. The extendable member is adjusted within the gap so that the one part and other part of the interlocking means cooperate when the sliding articles are in the closed position.

BRIEF DESCRIPTION OF THE DRAWINGS

These and other features of the present disclosure will become more apparent from the following description in which reference is made to the appended drawings wherein.

Figure 1:
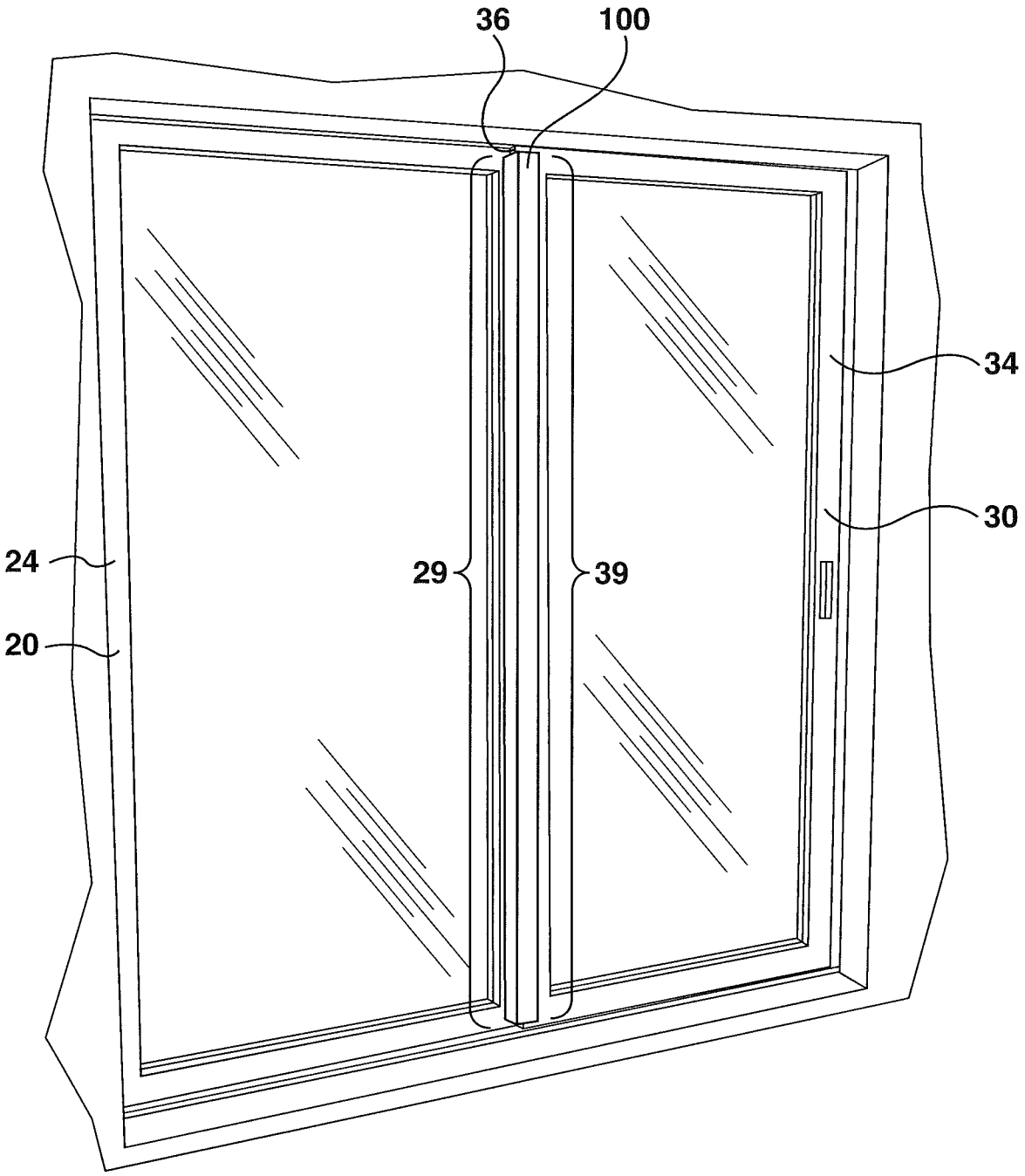
FIG. 1 is perspective view of an exemplary security device installed on sliding doors.

20 interior sliding door
22 inner face of interior door
24 outer face of interior door
26 edge of interior door
29 end region of interior door
30 exterior sliding door
32 inner face of exterior door
34 outer face of exterior door
36 edge of exterior door
40 another sliding door
100 security device
102, 402, 502, 602,702, 802, 902, 1002 first component
603, 703 flat section of first component
104, 404, 504, 604,704, 804, 904, 1004 fastener
805 small projections of first component
106, 406, 506, 606, 706, 806, 906, 1006 projection
707 outer side of second component
609, 709, 809, 909, 1009 edge of second component
110, 410, 510, 610, 710, 810, 910, 1010 second component
611 projection on second component
112, 412, 512, 612, 712, 812, 912, 1012 bracket
114, 414, 514, 614, 714, 814, 914, 1014 first leg
115, 415, 515, 615, 715, 815, 915, 1015 second leg
116, 416, 516, 616, 716, 816, 916, 1016 fastener
118, 418, 518, 618, 718, 818, 918, 1018 channel
619, 719, 819 recess on exterior side of the channel
120, 420, 520, 620, 720, 820, 920, 1020 extendable member
621 projection on extendable member
821A, 821B set of projections on extendable member
122, 422, 522, 622, 722, 822, 922, 1022 projection
124, 424, 524, 624, 724, 824, 924, 1024 fastener
625, 725, 825 cover
426, 726, 926 protrusion on bracket
627, 727, 827 projections on cover
860 recess on second component
870 third component
872 projection on third component
874 projection on fourth component
876 fourth component
526, 1026 toothed grip
528, 1028 lever
530, 1030 toothed edges
532, 1032 toothed sides
534, 1034 cylindrical encasement
540, 1040 hinged joint

DETAILED DESCRIPTION

One aspect of the present disclosure provides a mountable interlock security device, indicated generally by the reference numeral 100 in the accompanying figures, for securing first and second sliding articles defining interior and exterior articles having a gap therebetween. The first and second sliding articles 20, 30 are slidable relative to each other from an open position to a closed position such that in the closed position each sliding article 20, 30 has an overlapping end region, 29, 39 defined by an outer face 24, 34 and an inner face 22, 32, connected by an edge 29, 39. The security device 100 comprises a first component mountable 102 to the first sliding article and a second component mountable to the second sliding article.

The two components of the security device 100 are mounted to the edges 29, 39 or frames of the respective sliding articles such that when the sliding articles are in the closed position, the two components of the security device 100 cooperate to obscure the gap between the sliding articles. The sliding articles may be horizontally sliding doors or vertically sliding windows or the like to a building. In the accompanying illustrations, the sliding articles are shown as the interior sliding door 20 and exterior sliding door 30. One of the two sliding doors, 20 and 30, may be stationary.

Figure 2:
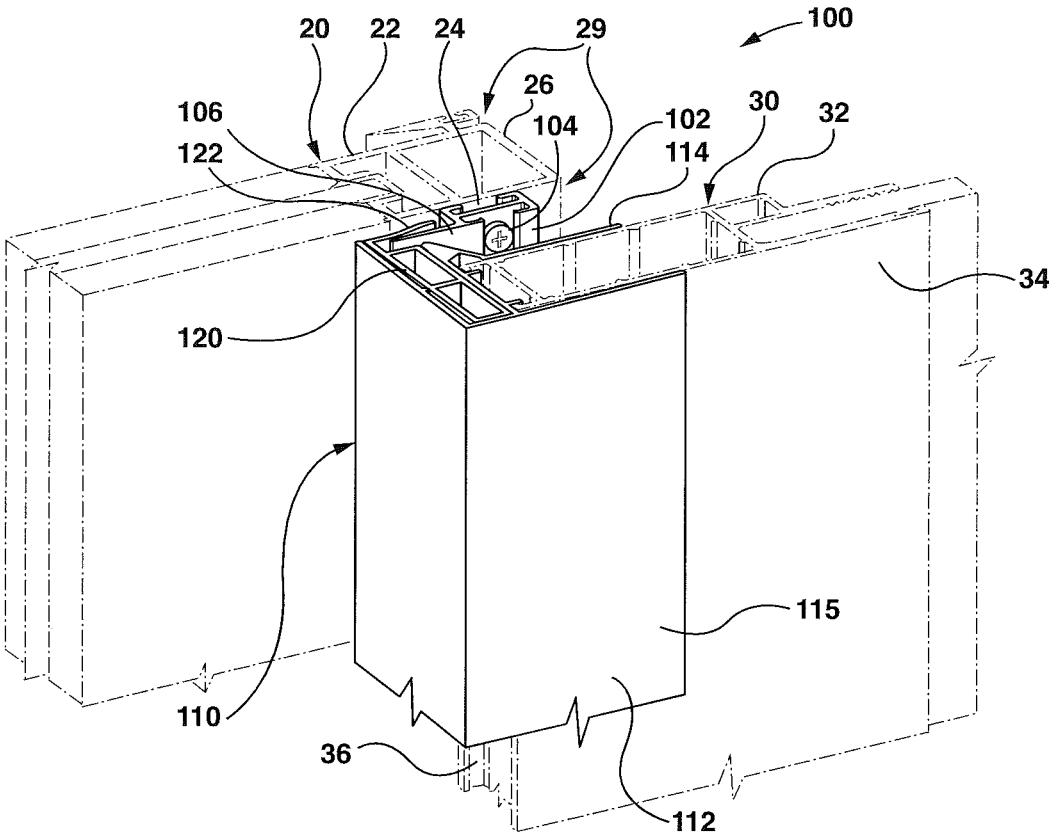
FIG. 2 is a detailed perspective cutaway view of FIG. 1.

As shown in one embodiment in FIG. 2, the first component 102 of the security device 100 is mounted to a portion of the end region 29 of the first sliding article 20. The first component 102 has a one part of an interlocking means 106 that extends into the gap between the interior and exterior sliding doors 20, 30. Accordingly, the first component 102 is mounted to the outer face 24 of the interior sliding door 20. Although shown as extending across the outer face 24, the first component 102 may optionally extend around the edge of the interior sliding door 20 and may wrap around the inner face 22 of the interior door 20 or take on any suitable shape as will be known to one skilled in the art. The first component 102 is secured to the outer frame face 22 of the interior sliding door 20 using securing means, 104, such as screws, bolts or other fasteners as will be known to one skilled in the art.

In the illustrated embodiments in the accompanying figures, the one part of the interlocking means is shown as a projection 106. The one part of the interlocking means may alternatively be a channel having an aperture for receiving a corresponding projection from the second component 110 as discussed below, or any other design for interlocking as will be known to one skilled in the art.

Figure 3:
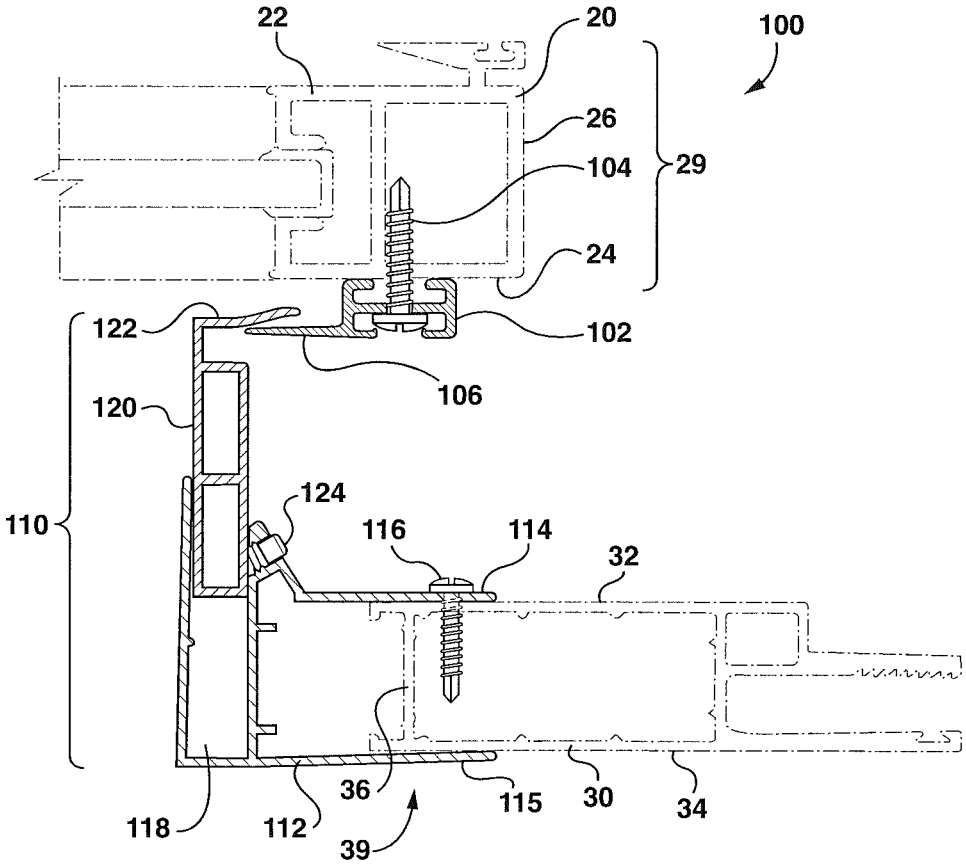
FIG. 3 is a cross-sectional plan view of the security device of FIG. 1 with the extendable member in an extended position.

The second component 110 of the security device 100 comprises a bracket 112 slidably mountable to the end region of the second sliding article. FIG. 3 shows the bracket 112 slidably mounted around the edge of the exterior sliding door 30 such that the legs 114, 115 of the bracket 112 wrap around the end of the exterior sliding door 30. The legs 114, 115 may be of different lengths relative to each other. The leg 115 of the bracket 112 extends across the outer frame 34 of the exterior door 30 sufficiently to prevent a gap between the exterior door 30 and the bracket 112, thereby limiting tampering with the security device 100. The leg 114 of the bracket 112 may be of any suitable length to permit placing a securing means, such as a screw 116 through the leg 114 and the frame to mount the bracket 112 to the exterior sliding door 30. To limit tampering with the second component 110 from the building exterior, the securing means 116 can be placed through the leg 114 facing the interior of the building.

The second component 110 also has an extendable member 120 receivable in the bracket 112. The extendable member 120 of the second component 110 engages with the one part of the interlocking means of the first component 102. In the accompanying illustrations, the extendable member 120 has a projection 122 that engages with the projection 106 of the first component 102. Thus, when the exterior door 30 is slid relative to the interior door 20 from an open position to a closed position, the projection 122 of the extendable member 120 of the second component 104 on the exterior door 30 overlaps with the projection 106 of the first component 102 mounted on the interior door 20. This overlap or interlock of the first and second component 102, 104 inhibits the prying apart of the sliding doors 20, 30 through the application of lateral force. When extending the length of the sliding doors, the bracket 112 and potentially the extendable member 120, if extended, also form a barrier against the insertion of objects such as crowbars between the two sliding doors to pry apart the sliding doors 20, 30.

To accommodate various spacing between existing interior and exterior sliding doors 20, 30, the security device 100 has an extendable feature. In one embodiment, the extendable member 120 is received in a channel 118 of the bracket 112 as shown in FIG. 3. The extendable member 120 of the second component 104 can be adjusted within the channel 118 to extend across the gap between existing sliding doors. Once the extendable member 120 is extended to its desired length, it may be secured using set screws 124 or securing means as will be known to one skilled in the art.

Figure 4A:
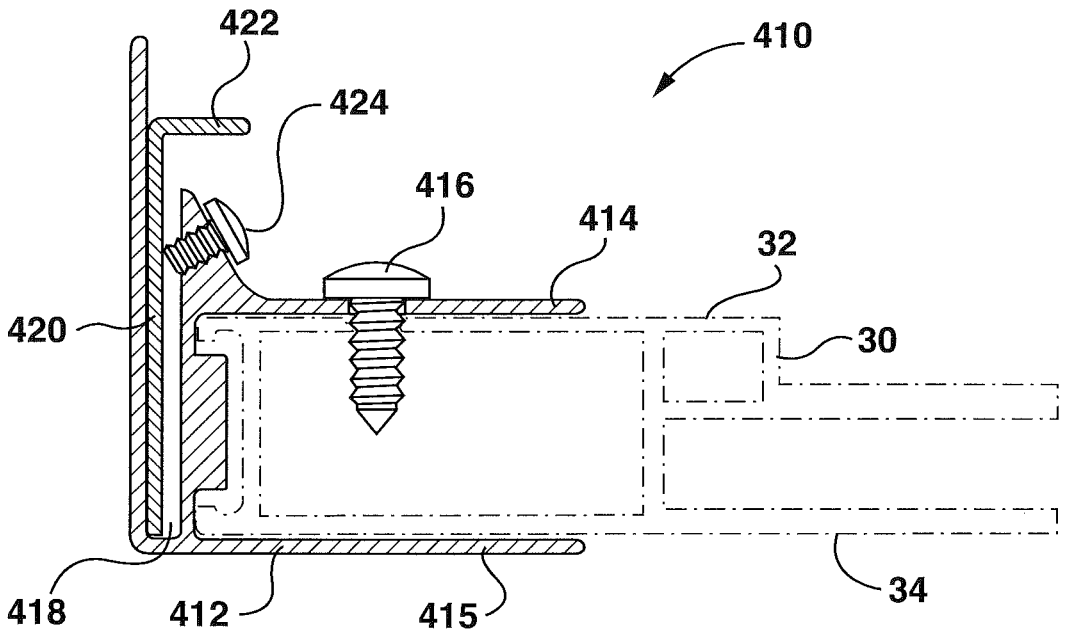
FIG. 4A is a cross-sectional plan view of an exemplary second component.
Figure 4B:
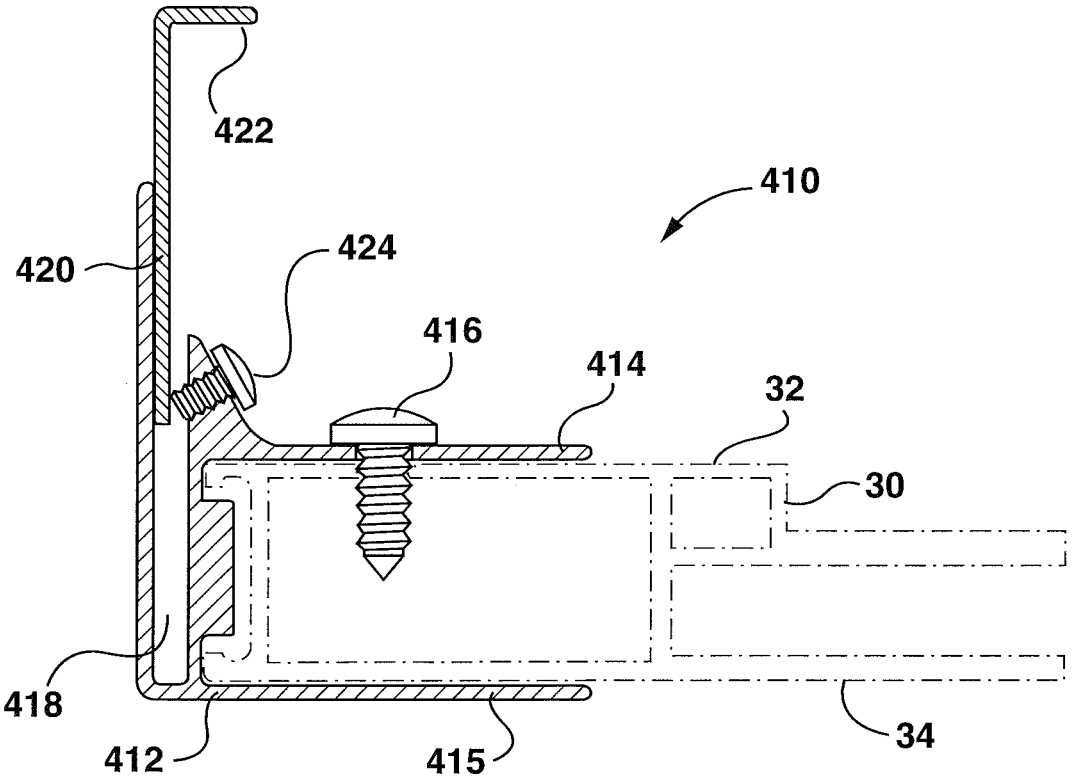
FIG. 4B is a cross-sectional plan view of the extendable member of FIG. 4A in an extended position.

FIGS. 4A and 4B show an alternate embodiment of a second component 410. Similar to the prior described embodiment, the second component 410 has a bracket 412 with legs 414 and 415 that wrap around the exterior door 30 and a channel 418 for receiving an extendable member 420. The bracket 412 in this case, is shaped differently, with a protrusion 426 that runs along the length of the second component 410 adjacent the edge of sliding door 30 to limit displacement of the second component 410. However, the bracket 412 may take on any suitable shape, such as the shape described with reference to FIGS. 2, 4A and 4B as described below.

Further, the bracket 412 has a narrower channel 418 to accommodate the slim extendable member 420 received in the channel 418. However, the channel 418 may be narrower or wider so long as the extendable member 420 is able to extend from within the channel 418. As in the prior described embodiment, the extendable member 420 can extend from the channel 418 to accommodate various spacing between the sliding doors 20, 30. Once extended to its desirable depth (i.e., extending across the gap between the two sliding doors 20, 30), the extendable member 420 may be secured in place using any securing means known to one skilled in the art such as a set screw 424. An alternative fastener may also be used. For example, a fastener may be used that extends partially or fully through the extendable member 420. When the sliding doors 20, 30 are slid closed relative to each other, the projection 422 of the extendable member 420 overlaps with the projection 106 of the first component 102. This overlap interlocks the two components to limit lateral movement of the sliding doors 20, 30 upon the application of lateral force. Similar to the prior described embodiment, the bracket 412 potentially in combination with the extendable member 420 obscures the gap between the two doors, thus limiting the insertion of objects in the gap that may otherwise be used to pry apart the doors.

Figure 5A:
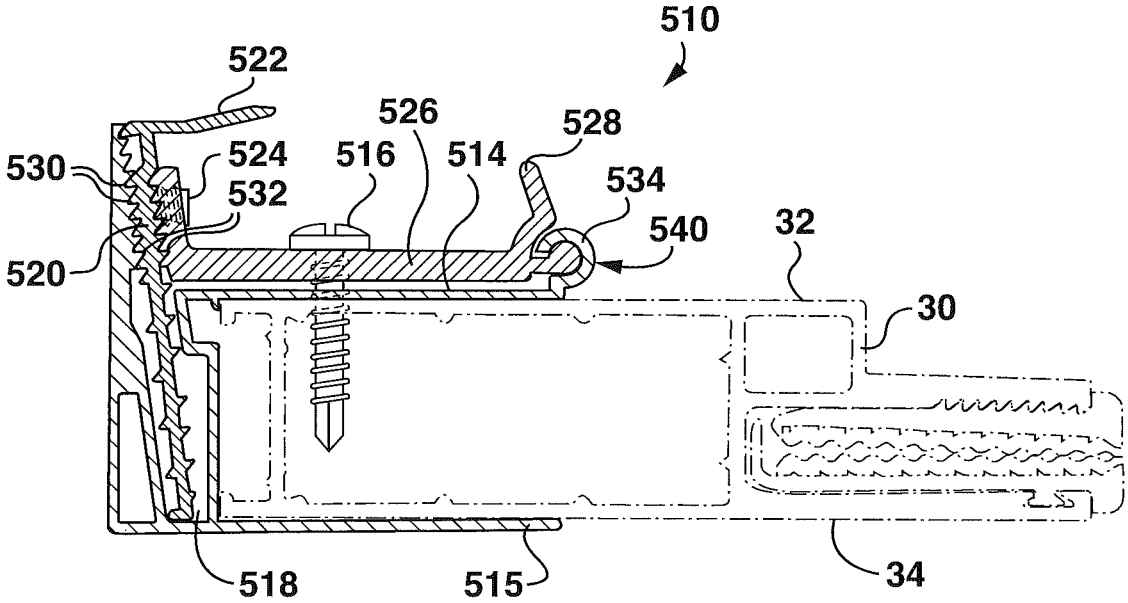
FIG. 5A is a cross-sectional plan view of an exemplary second component.
Figure 5B:
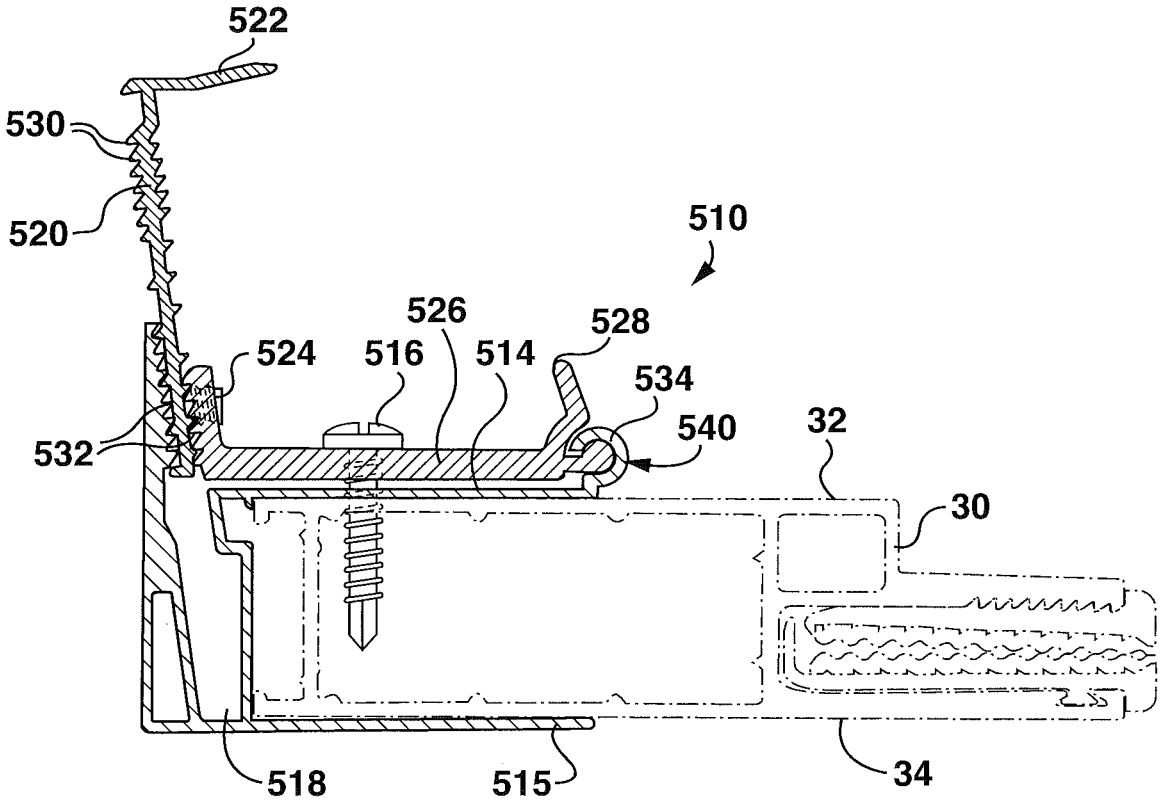
FIG. 5B is a cross-sectional plan view of the extendable member of FIG. 5A in an extended position.

In the alternate embodiments shown in FIGS. 5A and 5B, the extendable member 520 has toothed edges 530 that correspond to toothed sides 532 of the bracket 512. This toothed engagement of the extendable member 520 and the toothed sides of the bracket 512 grips the extendable member 520 in place. Thus, to permit extension of the extendable member 520, an alternative bracket 512 is shown. One interior side of the channel 418 of the bracket 512 has a toothed side 532. The channel 518 is of sufficient width to accommodate disengaging the toothed extendable member 520 from the toothed side 532 for movement within the gap between the sliding doors 20, 30. Once the extendable member 520 is extended to its desired position (i.e., so that it overlaps with the projection 106 when the sliding doors 20, 30 are in the closed position), a toothed grip 526 is moved into position so that the extendable member 520 is gripped between the toothed grip 526 and toothed side 532 of the channel 518. The extendable member 520 and toothed grip 526 may optionally be secured in place using a set screw 524 or any other securing means known to one skilled in the art.

The toothed grip 526 rests along the leg 514 of the bracket 512 and may be secured thereto using the same fastener 516 or securing means used to mount the bracket 512 to the exterior door 30. As shown in FIGS. 5A and 5B, the toothed grip 526 may also be hingedly attached to the leg 514 of the bracket 512 so that it is simply opened to permit the extendable member 520 to move within the channel 518, and closed to secure the extendable member 520 in place. Thus, the end of the leg 514 opposing its toothed side 530 may be formed as a partially cylindrical encasement 534 into which the end of the toothed grip 526 formed as a corresponding cylindrical pin is placed. This hinged joint 540 permits the toothed grip 526 to open into the gap permitting the extendable member 520 to move, and close, thus securing the extendable member 520. A lever 528 extending into the gap between the sliding doors 20, 30 may optionally be formed on the toothed grip 526 adjacent the hinged joint 540 so that pressing the lever 528 to rotate about the hinged joint enables rotation or opening of the entire toothed grip 526.

Figure 6A:
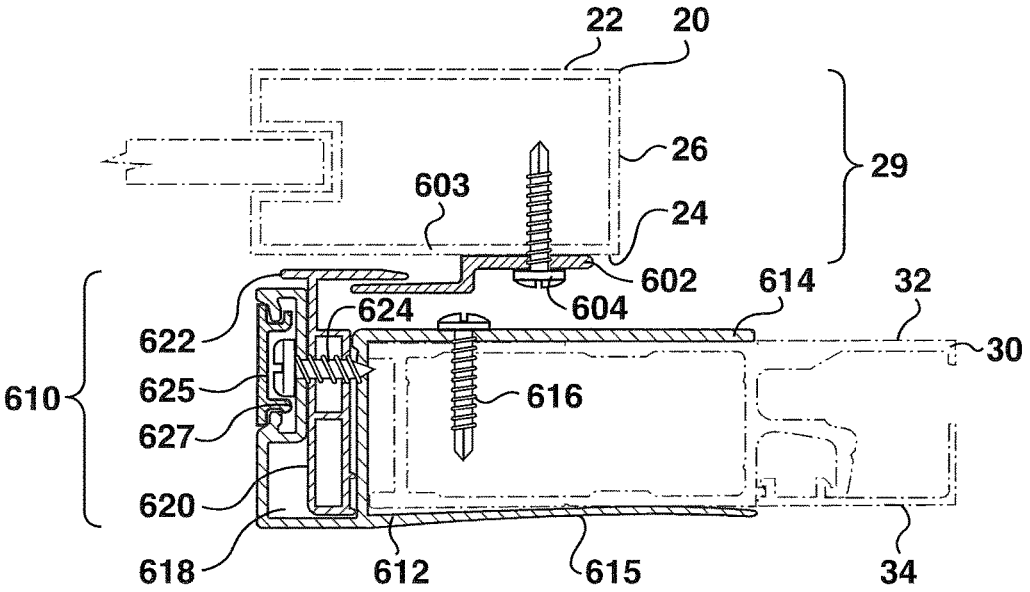
FIG. 6A is a cross-sectional plan view of an exemplary security device with the extendable member in a retracted position.
Figure 6B:
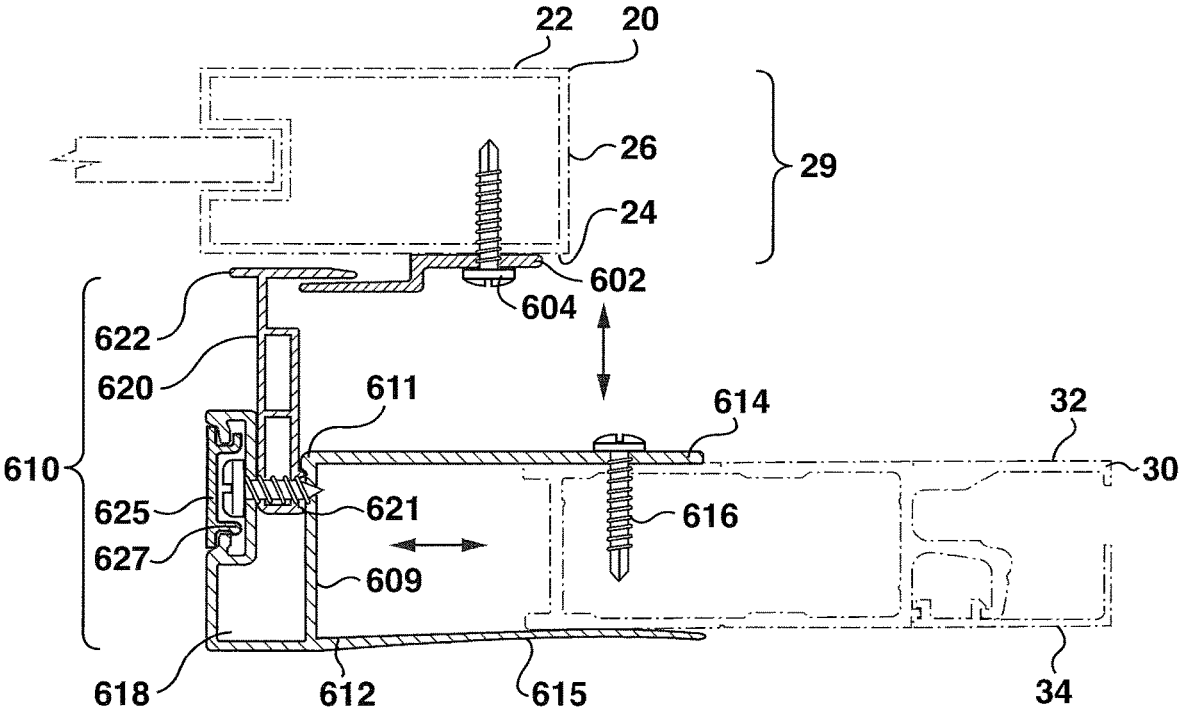
FIG. 6B is a cross-sectional plan view of the exemplary security device of FIG. 6A with the extendable member in an extended position.

FIGS. 6A and 6B show an alternate embodiment of a first component 602, a second component 610, an extendable member 620. Similar to the prior described embodiments, in FIGS. 6A and 6B the first component 602 is secured to the outer frame face 22 of the interior sliding door 20 using securing means 604, such as screws, bolts or other fasteners as will be known to one skilled in the art. The first component 602 is shaped differently than the previous example embodiments as it has a flat section 603 that is flush with the outer face 24 of the interior sliding door 20. The first component 602 may take on any suitable shape as will be known to one skilled in the art. As well, similar to the prior described embodiments, the second component 610 has a bracket 612 with legs 614 and 615 that wrap around the exterior door 30 and a channel 618 for receiving an extendable member 620. The bracket 612 in this case, is shaped differently, with longer legs 614 and 615 relative to the previous example embodiments, and on the exterior side of the channel 618, there is a recessed portion 619 where a fastener 624 is received and a cover 625 may be attached to cover the fastener 624 from view. The leg 614 of the bracket 612 may be of any suitable length to permit placing a securing means, such as a screw 616 through the leg 614 and the frame to mount the bracket 612 to the exterior sliding door 30. To limit tampering with the second component 610 from the building exterior, the securing means 616 can be placed through the leg 614 facing the interior of the building. However, the bracket 612 may take on any suitable shape, such as the other shapes described herein.

As shown in FIGS. 6A, 6B, the bracket 612 has a channel 618 that is wider at the bottom towards the second leg 615 as the recessed portion 619 reduces the width of the channel 618 at the top. However, the channel 618 may be narrower or wider so long as the extendable member 620 is able to extend from within the channel 618. As in the prior described embodiment, the extendable member 620 can extend from the channel 618 to accommodate various spacing between the sliding doors 20, 30. Once extended to its desirable depth (i.e., extending across the gap between the two sliding doors 20, 30), the extendable member 620 may be secured in place using any securing means known to one skilled in the art such as a set screw 624. An alternative fastener may also be used. For example, a fastener may be used that extends partially or fully through the extendable member 620. As shown in FIGS. 6A and 6B, the fastener 624 is received within the recessed portion 619 on the exterior side of the channel 618. A cover 625 may be placed over or within the recessed portion 619 to hide from view the fastener 624. The cover 625 may be secured to the recessed portion 619 with a snap-fit, friction-fit or other means of securing the cover 625 to and/or over the recessed portion 619. For example, in FIGS. 6A and 6B, the cover 625 have projections 627 to provide a snap-fit with projections 629 on the recessed portion 619 of the exterior side of the channel 620. When the sliding doors 20, 30 are slid closed relative to each other, the projection 622 of the extendable member 620 overlaps with the projection 606 of the first component 602. This overlap interlocks the two components to limit lateral movement of the sliding doors 20, 30 upon the application of lateral force. In the example embodiment shown in FIGS. 6A and 6B, the projection 622 is horizontal, however in other embodiments, the projection 622 may wholly or partially be sloped (for example, projection 122 in FIG. 3). Similar to the prior described embodiment, the bracket 612 potentially in combination with the extendable member 620 obscures the gap between the two doors, thus limiting the insertion of objects in the gap that may otherwise be used to pry apart the doors.

In the alternate embodiments shown in FIGS. 6A and 6B, FIG. 6A illustrates the regular and/or normal function of the security device 100 comprising the first component 602 and the second component 610, where the minimum distance in this embodiment between the outer face 24 of the interior sliding door 20 and the inner face 32 of the exterior sliding door 30 is 10 mm. FIG. 6B illustrates the adjustable and extendable function of the security device 100 comprising the first component 602 and the second component 610, where the maximum distance in this embodiment between the outer face 24 of the interior sliding door 20 and the inner face 32 of the exterior sliding door 30 is 25 mm. The extendable member 620 has a projection 621 that is in contact with a projection 611 on the second component 610 when the extendable member 620 is extended to its maximum range. The projections 611 and 621 provide a limiting point for the extendable member 620 for the maximum extension available. The fastener 624 may be used to fix and/or lock the position after adjustment. The second component 610 is also adjustable relative to the distance between the edge 609 of the second component 610 and the outer edge 36 of the exterior sliding door 30, where in this example embodiment, the maximum adjusted distance between the edge 609 of the second component 610 and the outer edge 36 of the exterior sliding door 30 is 25 mm.

Figure 7A:
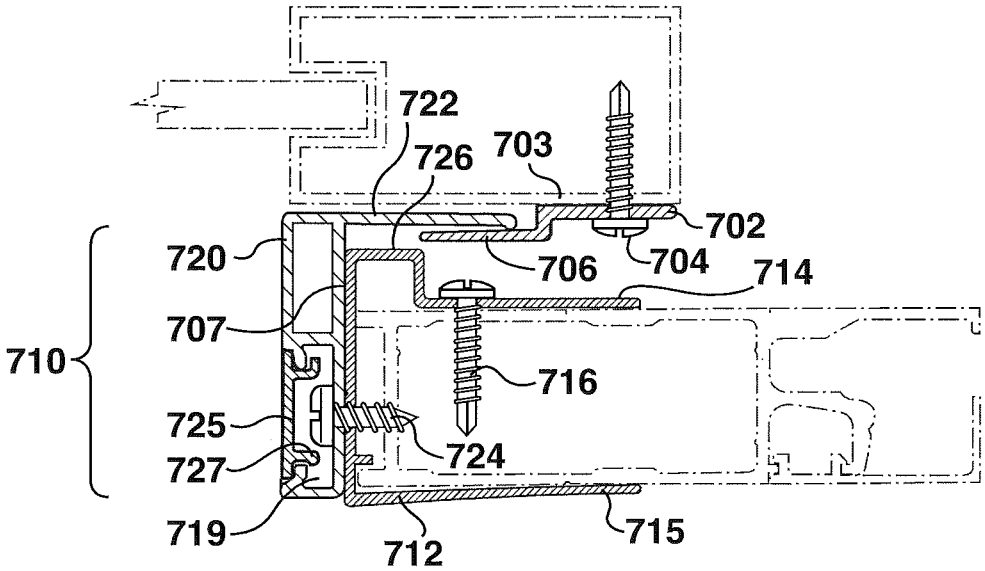
FIG. 7A is a cross-sectional plan view of an exemplary security device with the extendable member in a retracted position.
Figure 7B:
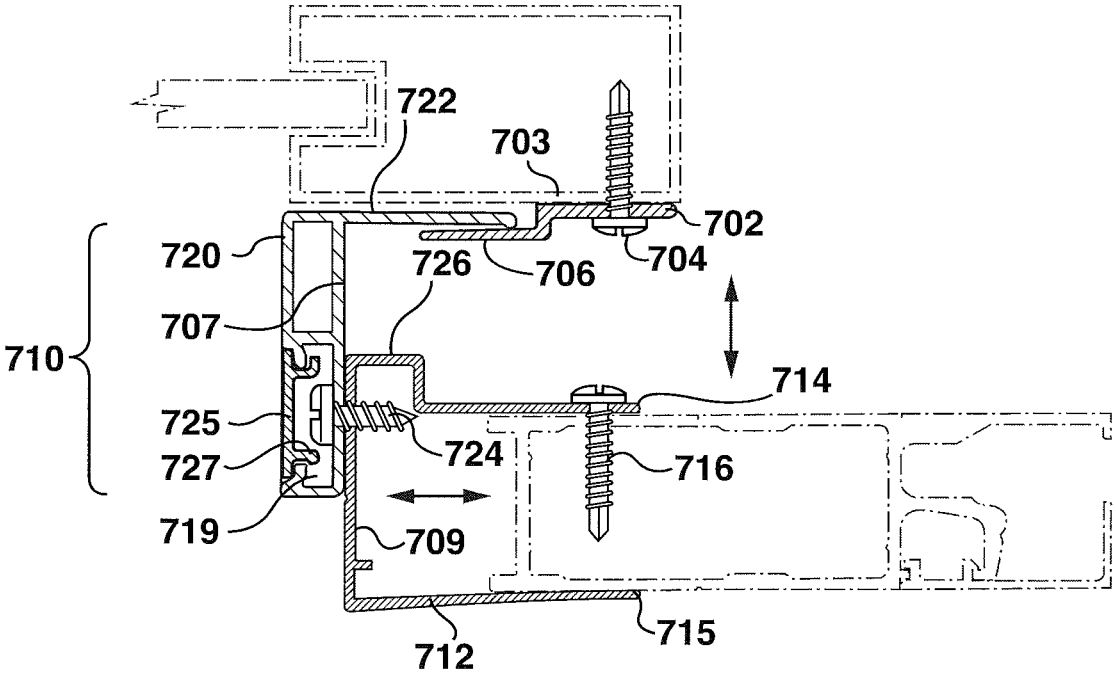
FIG. 7B is a cross-sectional plan view of the exemplary security device of FIG. 7A with the extendable member in an extended position.

FIGS. 7A and 7B show an alternate embodiment of a first component 702, a second component 704, an extendable member 720. Similar to the prior described embodiments, in FIGS. 7A and 7B the first component 702 is secured to the outer frame face 22 of the interior sliding door 20 using securing means, 704, such as screws, bolts or other fasteners as will be known to one skilled in the art. The first component 702 is shaped similarly to the example embodiment shown in FIGS. 6A and 6B as it has a flat section 703 that is flush with the outer face 24 of the interior sliding door 20. The first component 702 may take on any suitable shape as will be known to one skilled in the art. As well, similar to the prior described embodiments, the second component 710 has a bracket 712 with legs 714 and 715 that wrap around the exterior door 30. The bracket 712 in this case, is shaped differently, as it does not have a channel for receiving an extendable member 720. Rather, a side of the extendable member 720 aligns against the side 707 of the second component. The leg 714 of the bracket 712 may be of any suitable length to permit placing a securing means, such as a screw 716 through the leg 714 and the frame to mount the bracket 712 to the exterior sliding door 30. To limit tampering with the second component 710 from the building exterior, the securing means 716 can be placed through the leg 714 facing the interior of the building. However, the bracket 712 may take on any suitable shape, such as the other example shapes described herein.

As in the prior described embodiment, the extendable member 720 can extend to accommodate various spacing between the sliding doors 20, 30. Once extended to its desirable depth (i.e., extending across the gap between the two sliding doors 20, 30), the extendable member 720 may be secured in place using any securing means known to one skilled in the art such as a set screw 724. An alternative fastener may also be used. For example, a fastener may be used that extends partially or fully through the extendable member 720. As shown in FIGS. 7A and 7B, the extendable member 720 has a recessed portion 719 where the fastener 724 is received to secure the extendable member 720 to the bracket 712. A cover 725 may be placed over or within the recessed portion 719 to hide from view the fastener 724. The cover 725 may be secured to the recessed portion 719 with a snap-fit, friction-fit or other means of securing the cover 725 to and/or over the recessed portion 719. When the sliding doors 20, 30 are slid closed relative to each other, the projection 722 of the extendable member 720 overlaps with the projection 706 of the first component 702. This overlap interlocks the two components to limit lateral movement of the sliding doors 20, 30 upon the application of lateral force. In the example embodiment shown in FIGS. 7A and 7B, the projection 722 is horizontal, however in other embodiments, the projection 722 may wholly or partially be sloped (for example, projection 122 in FIG. 3). Similar to the prior described embodiment, the bracket 712 potentially in combination with the extendable member 720 obscures the gap between the two doors, thus limiting the insertion of objects in the gap that may otherwise be used to pry apart the doors.

In the alternate embodiments shown in FIGS. 7A and 7B, FIG. 7A illustrates the regular and/or normal function of the security device 100 comprising the first component 702 and the second component 710, where the minimum distance in this embodiment between the outer face 24 of the interior sliding door 20 and the inner face 32 of the exterior sliding door 30 is 12 mm. FIG. 7B illustrates the adjustable and extendable function of the security device 100 comprising the first component 702 and the second component 710, where the maximum distance in this embodiment between the outer face 24 of the interior sliding door 20 and the inner face 32 of the exterior sliding door 30 is 24 mm. The second component 710 is also adjustable relative to the distance between the edge 709 of the second component 710 and the outer edge 36 of the exterior sliding door 30, where in this example embodiment, the maximum adjusted distance between the edge 709 of the second component 710 and the outer edge 36 of the exterior sliding door 30 is 15 mm. The bracket 712 in this case has a protrusion 726 that runs along the length of the second component 710 adjacent the edge of sliding door 30 to limit displacement of the second component 710.

Figure 8A:
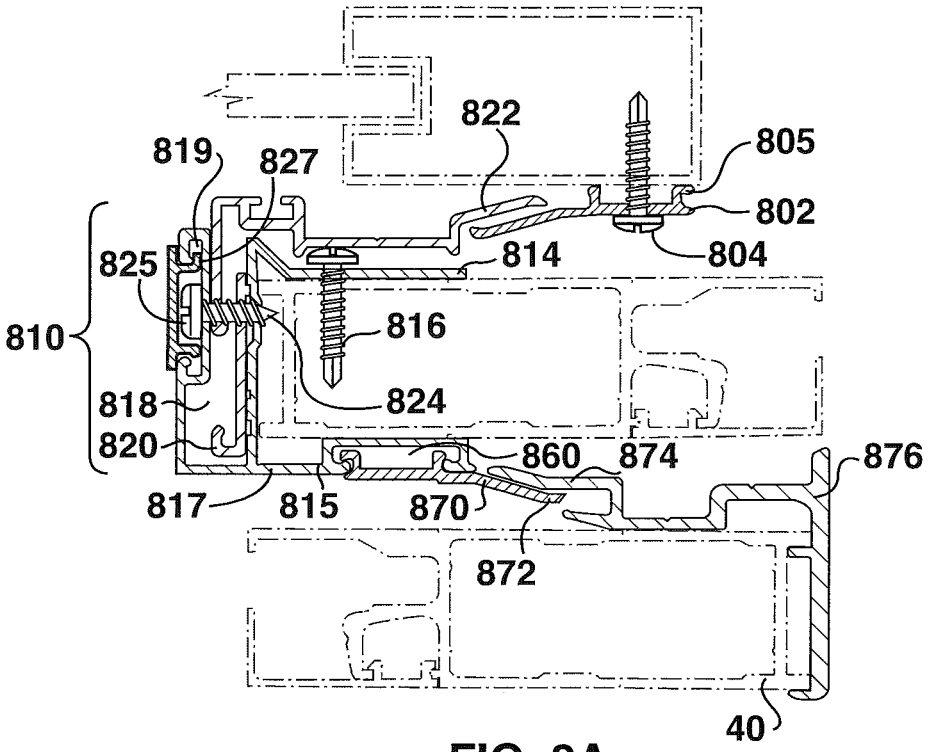
FIG. 8A is a cross-sectional plan view of an exemplary security device with the extendable member in a retracted position.
Figure 8B:
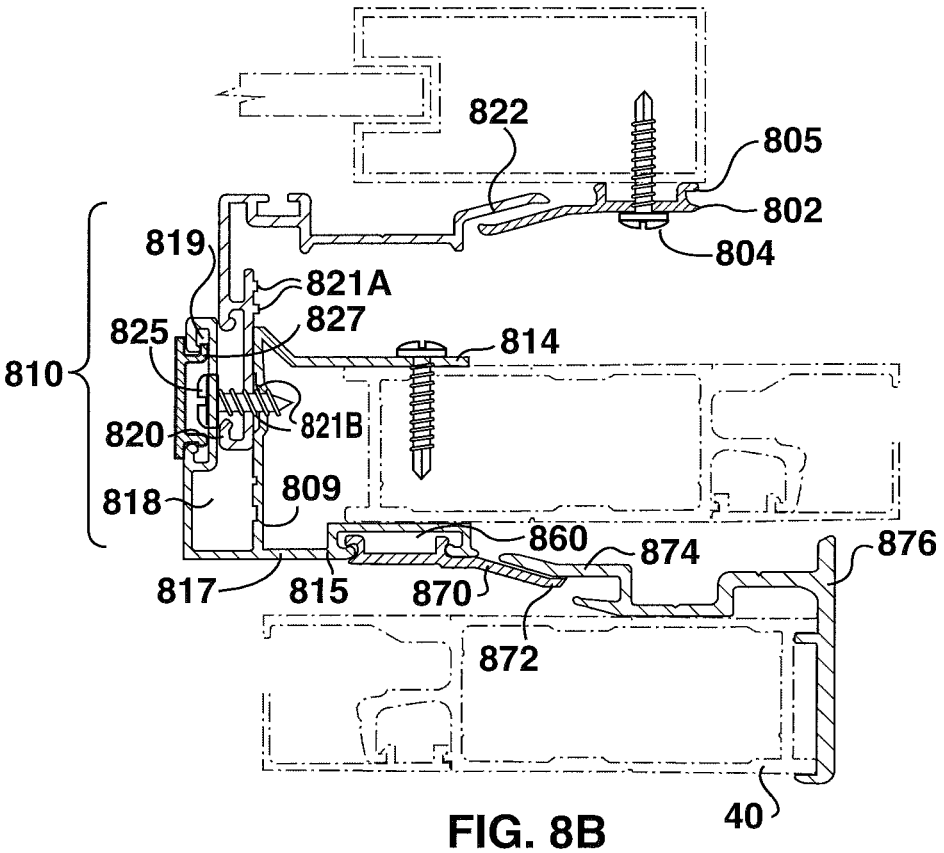
FIG. 8B is a cross-sectional plan view of the exemplary security device of FIG. 8A with the extendable member in an extended position.

FIGS. 8A and 8B show an alternate embodiment of a first component 802, a second component 810, an extendable member 820. Similar to the prior described embodiments, in FIGS. 8A and 8B the first component 802 is secured to the outer frame face 22 of the interior sliding door 20 using securing means 804, such as screws, bolts or other fasteners as will be known to one skilled in the art. The first component 802 is shaped differently than the previous example embodiments as it has small projections 805 that are mounted to a portion of the outer face 24 of the interior sliding door 20. The first component 802 may take on any suitable shape as will be known to one skilled in the art. As well, similar to the prior described embodiments, the second component 810 has a bracket 812 with legs 814 and 815 that wrap around the exterior door 30 and a channel 818 for receiving an extendable member 820. The bracket 812 in this case, is shaped differently, with recesses 813 on the interior side of the channel 818, and on the exterior side of the channel 618, there is a recessed portion 819 where a fastener 824 is received and a cover 825 may be attached to cover the fastener 824 from view. The leg 814 of the bracket 812 may be of any suitable length to permit placing a securing means, such as a screw 816 through the leg 814 and the frame to mount the bracket 812 to the exterior sliding door 30. To limit tampering with the second component 810 from the building exterior, the securing means 816 can be placed through the leg 814 facing the interior of the building. However, the bracket 812 may take on any suitable shape, such as the other shapes described herein.

As shown in FIGS. 8A, 8B, the bracket 812 has a channel 818 that is wider at the bottom towards the second leg 815 as the recessed portion 819 reduces the width of the channel 818 at the top. However, the channel 818 may be narrower or wider so long as the extendable member 820 is able to extend from within the channel 818. As in the prior described embodiment, the extendable member 820 can extend from the channel 818 to accommodate various spacing between the sliding doors 20, 30. Once extended to its desirable depth (i.e., extending across the gap between the two sliding doors 20, 30), the extendable member 820 may be secured in place using any securing means known to one skilled in the art such as a set screw 824. An alternative fastener may also be used. For example, a fastener may be used that extends partially or fully through the extendable member 820. As shown in FIGS. 8A and 8B, the fastener 824 is received within the recessed portion 819 on the exterior side of the channel 818. The cover 825 may be placed over or within the recessed portion 819 to hide from view the fastener 824. The cover 825 may be secured to the recessed portion 819 with a snap-fit, friction-fit or other means of securing the cover 825 to and/or over the recessed portion 619. For example, in FIGS. 8A and 8B, the cover 825 have projections 827 to provide a snap-fit with projections 829 on the recessed portion 819 of the exterior side of the channel 820. When the sliding doors 20, 30 are slid closed relative to each other, the projection 822 of the extendable member 820 overlaps with the projection 806 of the first component 802. This overlap interlocks the two components to limit lateral movement of the sliding doors 20, 30 upon the application of lateral force. In the example embodiment shown in FIGS. 8A and 8B, the projection 822 is sloped, however in other embodiments, the projection 822 may horizontal (for example, projection 722 in FIGS. 7A,7B). Similar to the prior described embodiment, the bracket 812 potentially in combination with the extendable member 820 obscures the gap between the two doors, thus limiting the insertion of objects in the gap that may otherwise be used to pry apart the doors.

In the alternate embodiments shown in FIGS. 8A and 8B, FIG. 8A illustrates the regular and/or normal function of the security device 100 comprising the first component 802 and the second component 810, where the minimum distance in this embodiment between the outer face 24 of the interior sliding door 20 and the inner face 32 of the exterior sliding door 30 is 11.5 mm. FIG. 6B illustrates the adjustable and extendable function of the security device 100 comprising the first component 802 and the second component 810, where the maximum distance in this embodiment between the outer face 24 of the interior sliding door 20 and the inner face 32 of the exterior sliding door 30 is 23 mm. The extendable member 820 has a first set of projections 821A and a second set of projections 821B that are in contact with recesses 813 on the second component 610 when the extendable member 820 is in the retracted position and when it is extended to its maximum range, respectively. The projections 821B provide a limiting point for the extendable member 620 for the maximum extension available, and both projections 821A and 821B act as a positional guide for moving the extendable member 820 between its retracted and extended positions. The second component 810 is also adjustable relative to the distance between the edge 809 of the second component 810 and the outer edge 36 of the exterior sliding door 30, where in this example embodiment, the maximum adjusted distance between the edge 809 of the second component 810 and the outer edge 36 of the exterior sliding door 30 is 10 mm.

Additionally, as shown in FIGS. 8A and 8B, the second component 810 has a recess 860 that may receive a third component 870 shaped similar to the first component 802. The third component 870 has a projection 872 that engages a projection 874 on a fourth component 876. The fourth component 876 may be slidably mounted around the edge of a third door 40. Accordingly, the embodiment in FIGS. 8A and 8B provides a security device 100 for a door system have a three door arrangement.

Figure 9A:
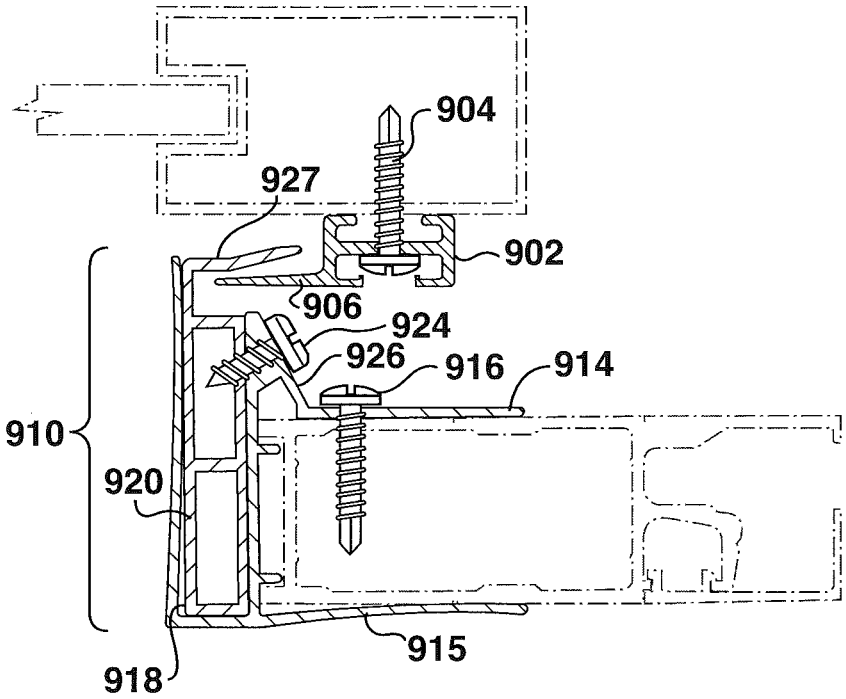
FIG. 9A is a cross-sectional plan view of an exemplary security device with the extendable member in a retracted position.
Figure 9B:
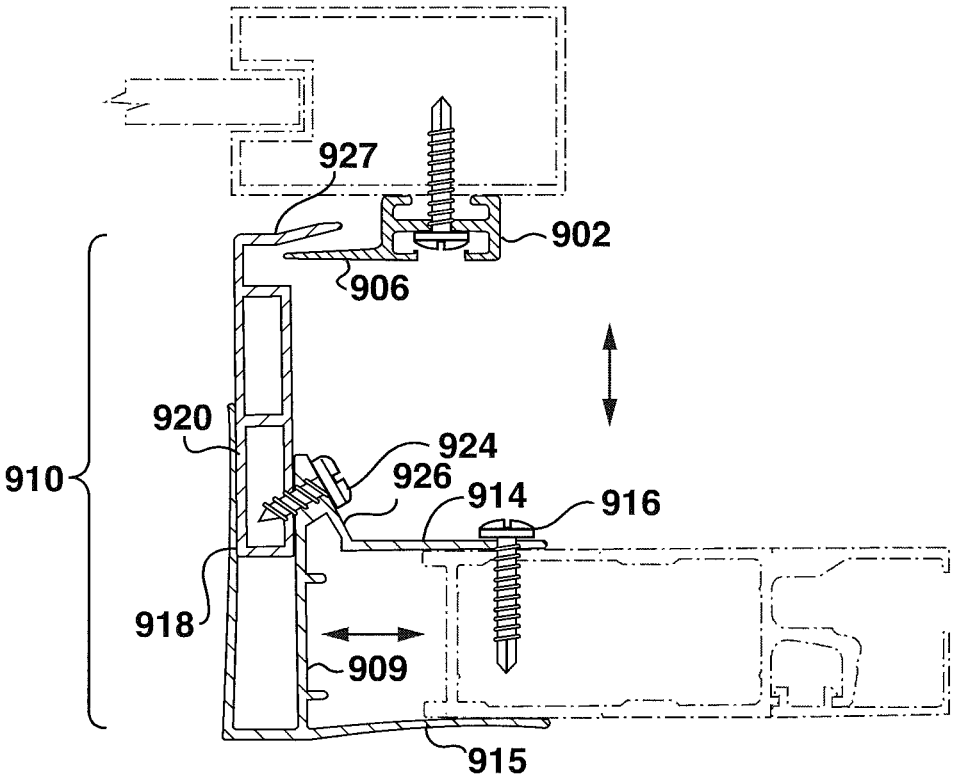
FIG. 9B is a cross-sectional plan view of the exemplary security device of FIG. 9A with the extendable member in an extended position.

FIGS. 9A and 9B illustrate a similar example embodiment to that of FIG. 3, in which FIG. 9A illustrates the regular and/or normal function of the security device 100 comprising a first component 902 and a second component 910 and in which FIG. 9B illustrates the adjustable and extendable function of the security device 100 comprising the first component 902 and the second component 910. The second component 910 of the security device 100 comprises a bracket 912 slidably mountable to the end region of the second sliding article. FIG. 9A shows the bracket 912 slidably mounted around the edge of the exterior sliding door 30 such that the legs 914, 915 of the bracket 912 wrap around the end of the exterior sliding door 30. The legs 914, 915 may be of different lengths relative to each other. The leg 915 of the bracket 912 extends across the outer frame 34 of the exterior door 30 sufficiently to prevent a gap between the exterior door 30 and the bracket 912, thereby limiting tampering with the security device 100. The leg 914 of the bracket 912 may be of any suitable length to permit placing a securing means, such as a screw 916 through the leg 914 and the frame to mount the bracket 912 to the exterior sliding door 30. To limit tampering with the second component 910 from the building exterior, the securing means 916 can be placed through the leg 914 facing the interior of the building.

The second component 910 also has an extendable member 920 receivable in the bracket 912. The extendable member 920 of the second component 910 engages with the one part of the interlocking means of the first component 902. In the accompanying illustrations, the extendable member 920 has a projection 922 that engages with the projection 906 of the first component 902. Thus, when the exterior door 30 is slid relative to the interior door 20 from an open position to a closed position, the projection 922 of the extendable member 920 of the second component 904 on the exterior door 30 overlaps with the projection 906 of the first component 902 mounted on the interior door 20. This overlap or interlock of the first and second component 902, 904 inhibits the prying apart of the sliding doors 20, 30 through the application of lateral force. When extending the length of the sliding doors, the bracket 912 and potentially the extendable member 920, if extended, also form a barrier against the insertion of objects such as crowbars between the two sliding doors to pry apart the sliding doors 20, 30.

To accommodate various spacing between existing interior and exterior sliding doors 20, 30, the security device 100 has an extendable feature. In an embodiment shown in FIGS. 9A and 9B, the extendable member 920 is received in a channel 918 of the bracket 912. The extendable member 920 of the second component 910 can be adjusted within the channel 918 to extend across the gap between existing sliding doors. Once the extendable member 920 is extended to its desired length, it may be secured using set screws 924 or securing means as will be known to one skilled in the art. FIG. 9A shows the extendable member 920 in a regular and/or normal position fully received within the channel 918, wherein the minimum distance in this embodiment between the outer face 24 of the interior sliding door 20 and the inner face 32 of the exterior sliding door 30 is 22 mm. FIG. 9B shows the extendable member 920 in a fully extended position, wherein the maximum distance in this embodiment between the outer face 24 of the interior sliding door 20 and the inner face 32 of the exterior sliding door 30 is 44 mm. The bracket 912 in this case has a protrusion 926 that runs along the length of the second component 910 adjacent the edge of sliding door 30 to limit displacement of the second component 910. Accordingly, the security device 100 of the present invention is adjustable and/or customizable to accommodate varying distances between the interior sliding door 20 and the exterior sliding door 30. The second component 910 is also adjustable relative to the distance between the edge 909 of the second component 910 and the outer edge 36 of the exterior sliding door 30, where in this example embodiment, the maximum adjusted distance between the edge 909 of the second component 910 and the outer edge 36 of the exterior sliding door 30 is 16 mm.

Figure 10A:
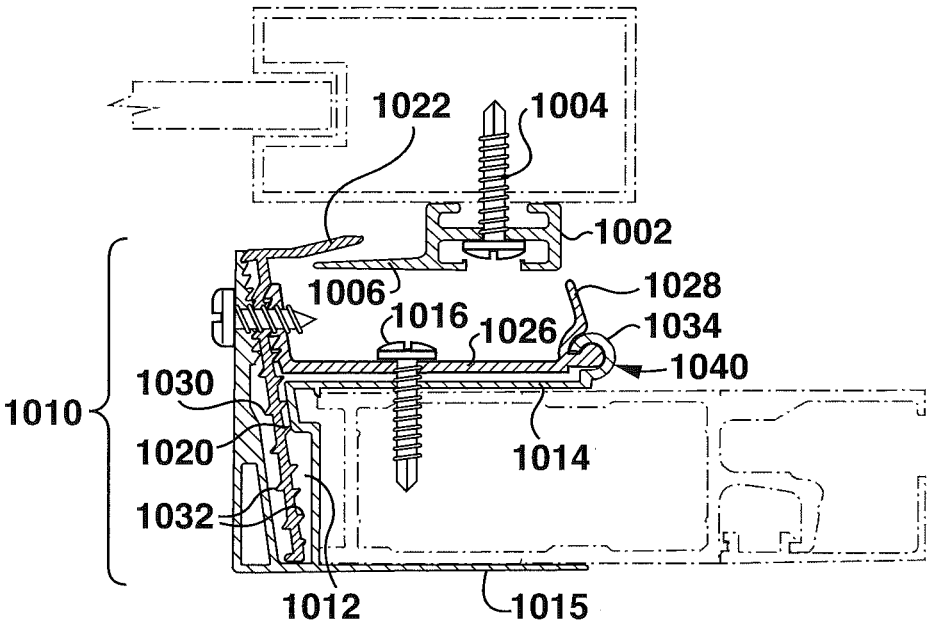
FIG. 10A is a cross-sectional plan view of an exemplary security device with the extendable member in a retracted position.
Figure 10B:
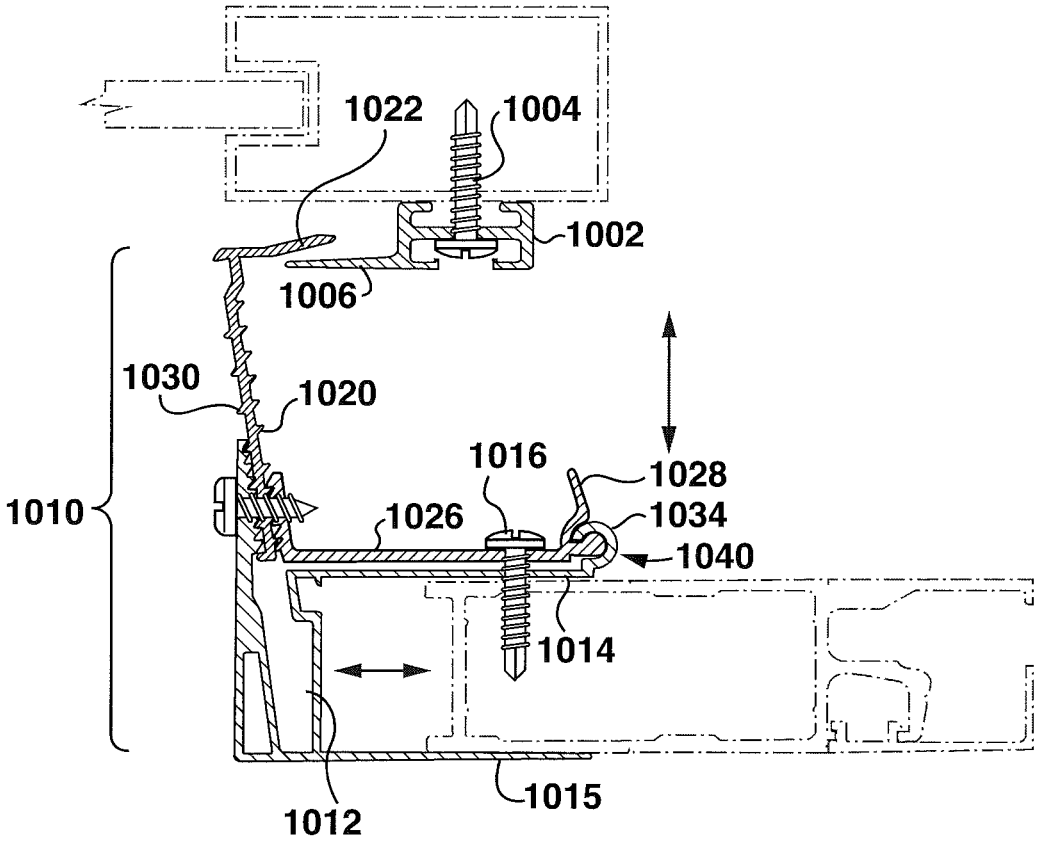
FIG. 10B is a cross-sectional plan view of the exemplary security device of FIG. 10B with the extendable member in an extended position.

FIGS. 10A and 10B illustrate a similar example embodiment to that of FIGS. 5A, 5B, in which FIG. 10A illustrates the regular and/or normal function of the security device 100 comprising a first component 1002 and a second component 1010 and in which FIG. 10B illustrates the adjustable and extendable function of the security device 100 comprising the first component 1002 and the second component 1010. In the alternate embodiment shown in FIGS. 10A and 10B, the extendable member 1020 has toothed edges 1030 that correspond to toothed sides 1032 of the bracket 1012. This toothed engagement of the extendable member 1020 and the toothed sides of the bracket 1012 grips the extendable member 1020 in place. Thus, to permit extension of the extendable member 1020, an alternative bracket 1012 is shown. One interior side of the channel 1018 of the bracket 1012 has a toothed side 1032. The channel 1018 is of sufficient width to accommodate disengaging the toothed extendable member 1020 from the toothed side 1032 for movement within the gap between the sliding doors 20, 30. Once the extendable member 1020 is extended to its desired position (i.e., so that it overlaps with the projection 1006 when the sliding doors 20, 30 are in the closed position), a toothed grip 1026 is moved into position so that the extendable member 1020 is gripped between the toothed grip 1026 and toothed side 1032 of the channel 1018. The extendable member 1020 and toothed grip 1026 may optionally be secured in place using a set screw 1024 or any other securing means known to one skilled in the art.

The toothed grip 1026 rests along the leg 1014 of the bracket 1012 and may be secured thereto using the same fastener 1016 or securing means used to mount the bracket 1012 to the exterior door 30. As shown in FIGS. 10A and 10B, the toothed grip 1026 may also be hingedly attached to the leg 1014 of the bracket 1012 so that it is simply opened to permit the extendable member 1020 to move within the channel 1018, and closed to secure the extendable member 1020 in place. Thus, the end of the leg 1014 opposing its toothed side 1030 may be formed as a partially cylindrical encasement 1034 into which the end of the toothed grip 1026 formed as a corresponding cylindrical pin is placed. This hinged joint 1040 permits the toothed grip 1026 to open into the gap permitting the extendable member 1020 to move, and close, thus securing the extendable member 1020. A lever 1028 extending into the gap between the sliding doors 20, 30 may optionally be formed on the toothed grip 1026 adjacent the hinged joint 1040 so that pressing the lever 1028 to rotate about the hinged joint enables rotation or opening of the entire toothed grip 1026.

To accommodate various spacing between existing interior and exterior sliding doors 20, 30, the security device 100 has an extendable feature. In an embodiment shown in FIGS. 10A and 10B, the extendable member 1020 is received in a channel 1018 of the bracket 1012. The extendable member 1020 of the second component 1010 can be adjusted within the channel 1018 to extend across the gap between existing sliding doors. Once the extendable member 1020 is extended to its desired length, it may be secured using set screws 1024 or securing means as will be known to one skilled in the art. FIG. 10A shows the extendable member 1020 in a regular and/or normal position fully received within the channel 1018, wherein the minimum distance in this embodiment between the outer face 24 of the interior sliding door 20 and the inner face 32 of the exterior sliding door 30 is 21 mm. FIG. 10B shows the extendable member 1020 in a fully extended position, wherein the maximum distance in this embodiment between the outer face 24 of the interior sliding door 20 and the inner face 32 of the exterior sliding door 30 is 44 mm. Accordingly, the security device 100 of the present invention is adjustable and/or customizable to accommodate varying distances between the interior sliding door 20 and the exterior sliding door 30. The second component 1010 is also adjustable relative to the distance between the edge 1009 of the second component 1010 and the outer edge 36 of the exterior sliding door 30, where in this example embodiment, the maximum adjusted distance between the edge 1009 of the second component 1010 and the outer edge 36 of the exterior sliding door 30 is 12 mm.

Figure 11:
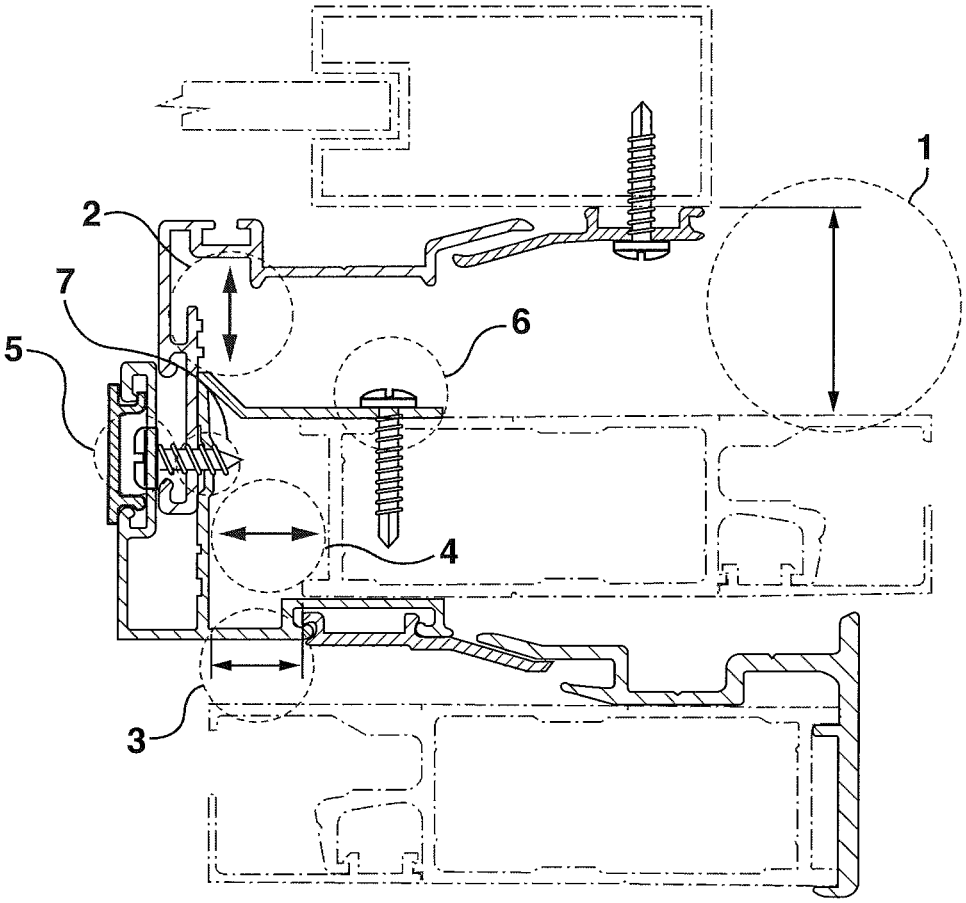
FIG. 11 is a cross-sectional plan view of an exemplary security device illustrating the elements identified in Table 1.

The following Table 1 provides a comparison of the example embodiments shown in FIGS. 6A, 6B, 7A, 7B, 8A, 8B, 9A, 9B, and 10A, 10B. The item numbers indicated in Table are shown in FIG. 11. The measurements provided in the table are examples only and the security device 100 of the various example embodiments may have different adjustable heights and widths than those indicated in Table 1. As well, there may be embodiments of the security device 100 that has a combination of elements that is not shown FIGS. 6A, 6B-10A, 10B or described in Table 1. For example, the security device 100 may encompass various combinations of the individual elements shown in FIGS. 6A, 6B-10A, 10B and indicated in Table 1.

Interlock Adjustable Device - Example Embodiments Comparison

| Item No. | Description | FIGS. 6A, 6B | FIGS. 7A, 7B | FIGS. 8A, 8B | FIGS. 9A, 9B | FIGS. 10A, 10B |
|---|---|---|---|---|---|---|
| 1 | Depth interlock extension adjustable (height) | Min. 10 mm. Max. 25 mm. | Min. 12 mm. Max. 24 mm. | Min. 11.5 mm. Max. 23 mm. | Min. 22 mm. Max. 44 mm. | Min. 21 mm. Max. 44 mm. |
| 2 | Depth holding interlock function | Channel | No | Channel | Channel | Channel |
| 3 | Horizontal sweep extension adjustable (maximum width) | 25 mm. | 15 mm. | 10 mm. | 16 mm. | 12 mm. |
| 4 | Horizontal holding interlock function | Channel + slot guide | Channel + slot guide | Channel + slot guide | Channel + slot guide | Channel + slot guide |
| 5 | Hidden interlock fixing screw | Snap cover | Snap cover | Snap cover | Snap cover | Snap cover |
| 6 | Hidden housing interlock fixing screw | No | No | Hidden 1 side | No | No |
| 7 | Maximum extension trigger point | Stop by step bumper | Visible V-line | Stop by step bumper | Visible V-line | Stop by step serrate |

The first component of the security device 100 may alternatively be mounted to the inner frame face of the exterior door (not shown). This embodiment, while permitting the one part of the interlocking means to cooperate with the other part of the interlocking means in the gap between the sliding doors, would not necessarily obscure the gap between the two doors. Additionally, although the illustrated embodiments provide for security device extending the length of the sliding articles to which it is mounted, one or more security devices may be mounted along the length of the sliding articles. Similar to the scenario above, while this would permit the two components to interlock and thereby limit lateral movement, this arrangement would not necessarily obscure the gap between the two doors.

A method of retrofitting interior and exterior sliding articles of a building, slidable relative to each other from an open position to a closed position and defining a gap therebetween is also provided. The sliding articles here may be interior and exterior sliding doors or windows or the like. First, a mountable interlock security device is provided comprising a first component with a one part of an interlocking means and a second part having an extendable member. The extendable member has an other part of an interlocking means. The interlock security device may take on any of the embodiments described above.

The first component is mounted to the interior sliding article so that the one part of the interlocking means extends into the gap. The second component is mounted to the exterior sliding article so that the extendable member extends into the gap. The extendable member is then adjusted, if necessary, within the gap so that the one part and the other part of the interlocking means cooperate when the sliding articles are in the closed position. A securing means may be added to secure the extendable member in its adjusted position.

One or more currently preferred embodiments have been described by way of example. It will be apparent to persons skilled in the art that a number of variations and modifications can be made without departing from the scope as defined in the claims.

What is claimed is:

1. A mountable interlock security device for securing first and second sliding articles defining interior and exterior articles having a gap therebetween, the first and second sliding articles being slidable relative to each other from an open position to a closed position such that in the closed position each first and second sliding article has end regions that overlap the end region of the other sliding article, each end region being defined by an outer face and an inner face connected by an edge, an outer face of the first sliding article facing an inner face of the second sliding article, the security device comprising:

a first component mountable to at least a portion of the end region of the first sliding article, said first component having a one part of an interlocking mechanism for extending into the gap between the first and second sliding articles;

a second component mountable to the end region of the second sliding article, said second component including:

a bracket slidably mountable to the end region of the second sliding article;

said bracket having a channel facing the first sliding article and facing into the gap, said bracket being mountable adjacent the edge of the second sliding article;

an extendable member receivable in said channel for adjustably extending relative to said bracket in a sliding manner into the gap for accommodating different spacings between the first and second sliding articles; and an other part of the interlocking mechanism extending from an end portion of said extendable member into the gap between the first and second sliding articles;

wherein said one part of the interlocking mechanism of said first part cooperates with said other part of the interlocking mechanism of said second part for limiting lateral movement of the first and second sliding articles in the closed position upon the application of lateral force; and wherein the first and second components block the gap between the first and second sliding articles.

2. The security device of claim 1, wherein said first sliding article is an interior sliding article and the first component is mountable to the inner face of the interior sliding article.

3. The security device of claim 1, wherein the second component is extendable from the end region of the second sliding article.

4. The security device of claim 1, wherein the extendable member has a first projection and the bracket has a second projection, wherein the first projection cooperates with the second projection for limiting the extension of the extendable member.

5. A mountable interlock security device for securing first and second sliding articles defining interior and exterior articles having a gap therebetween, the first and second sliding articles being slidable relative to each other from an open position to a closed position such that in the closed position each first and second sliding article has an end region that overlaps the end region of the other sliding article, each end region being defined by an outer face and an inner face connected by an edge, an outer face of the first sliding article facing an inner face of the second sliding article, the security device comprising:

a first component mountable to at least a portion of the end region of the first sliding article, said first component having a one part of an interlocking mechanism for extending into the gap between the first and second sliding articles; and a two piece second component, a first piece of the two piece second component being mountable to the end region of the second sliding article;

a second piece of the two piece second component adjustably extending from the first piece into the gap between the first and second sliding articles to accommodate different spacings between the first sliding article and the second sliding article;

the second piece having another part of the interlocking mechanism, the another part of the interlocking mechanism extending from an end portion of the second piece;

wherein said one part of the interlocking mechanism said first part cooperates with said another part of the interlocking mechanism of said second part for limiting lateral movement of the first and second sliding articles in the closed position upon the application of lateral force; and wherein the first and second components block the gap between the first and second sliding articles.

6. The security device of claim 5, wherein the second component comprises a bracket slidably mountable to the end region of the second sliding article.

7. The security device of claim 5, wherein the second piece of the second component comprises an extendable member aligned against the exterior side of a bracket at the end region of the second sliding article, the extendable member for extending into the gap for accommodating spacing between the first and second sliding articles.

8. The security device of claim 5, wherein said first component is mountable to an interior side of the first sliding article.

9. The security device of claim 8, wherein said first component is mountable to the inner face of the interior sliding article.

10. The security device of claim 5, wherein the second piece of the second component is extendable from the end region of the second sliding article.

11. The security device of claim 7, wherein the second piece has a first projection, wherein the first projection cooperates with a second projection on the first component for limiting the extension of the extendable member.

12. The security device claim 7, wherein the bracket has a protrusion along the length of the second component adjacent to the edge of the second sliding article to limit displacement of the second component.

* * * * *